US011315718B2

(12) United States Patent
Jung

(10) Patent No.: US 11,315,718 B2
(45) Date of Patent: Apr. 26, 2022

(54) COIL COMPONENT AND METHOD FOR MANUFACTURING THE SAME

(71) Applicant: SAMSUNG ELECTRO-MECHANICS CO., LTD., Suwon-si (KR)

(72) Inventor: Hye Won Jung, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 412 days.

(21) Appl. No.: 16/059,657

(22) Filed: Aug. 9, 2018

(65) Prior Publication Data

US 2019/0103208 A1 Apr. 4, 2019

(30) Foreign Application Priority Data

Sep. 29, 2017 (KR) ..... 10-2017-0127952

(51) Int. Cl.

| | |
|---|---|
| ***H01F 17/00*** | (2006.01) |
| ***H01F 41/04*** | (2006.01) |
| ***H01F 27/29*** | (2006.01) |
| *H01F 27/28* | (2006.01) |

(52) U.S. Cl.

CPC ..... *H01F 17/0013* (2013.01); *H01F 27/292* (2013.01); *H01F 41/041* (2013.01); *H01F 2017/002* (2013.01); *H01F 2017/0073* (2013.01); *H01F 2027/2809* (2013.01)

(58) Field of Classification Search

CPC ..... H01F 17/0006; H01F 17/0013; H01F 27/2804; H01F 27/292; H01F 2017/002; H01F 2017/0073; H01F 2017/0086; H01F 2027/2809

USPC ..... 336/200, 232

See application file for complete search history.

(56) References Cited

U.S. PATENT DOCUMENTS 5,515,022 A * 5/1996 Tashiro ..... H01F 17/0013 174/262
6,010,769 A * 1/2000 Sasaoka ..... H01L 24/16 428/209
2002/0159242 A1 10/2002 Nakatani et al.
2003/0098767 A1 5/2003 Girardie et al.

(Continued)

FOREIGN PATENT DOCUMENTS

JP H05-335744 A 12/1993
JP 2003-234413 A 8/2003

(Continued)

OTHER PUBLICATIONS

Korean Office Action dated Jan. 3, 2022 , issued in corresponding Korean Patent Application No. 10-2017-0127952 (with English translation).

*Primary Examiner* — Tszfung J Chan

(74) *Attorney, Agent, or Firm* — Morgan, Lewis & Bockius LLP

(57) ABSTRACT

A coil component includes a body including a plurality of pattern layers and a via electrode layer connecting the respective conductive pattern layers to each other, and external electrodes disposed on an external surface of the body. A cross-sectional shape of the via electrode layer is divided into an upper region and a lower region, a side surface of the upper region has a tapered shape, and a lower surface of the lower region includes a curved portion.

12 Claims, 6 Drawing Sheets

(56) References Cited

U.S. PATENT DOCUMENTS

| | | | | |
|---|---|---|---|---|
| 2005/0151613 | A1 | 7/2005 | Takaya et al. | |
| 2012/0306607 | A1* | 12/2012 | Jeong | H01F 17/0013 336/192 |
| 2016/0196906 | A1* | 7/2016 | Kim | H01F 17/0013 336/192 |
| 2017/0006704 | A1* | 1/2017 | Yoshioka | H01F 3/08 |

FOREIGN PATENT DOCUMENTS

| | | | | | |
|---|---|---|---|---|---|
| JP | 2004055897 | A | * | 2/2004 | H05K 3/421 |
| JP | 2009277972 | A | * | 11/2009 | |
| KR | 10-2002-0005749 | | | 1/2002 | |
| KR | 10-2004-0082290 | A | | 9/2004 | |
| KR | 10-2006-0037658 | A | | 5/2006 | |
| KR | 10-2012-0133570 | A | | 12/2012 | |
| KR | 10-2017-0004861 | A | | 1/2017 | |
| WO | WO-2004043121 | A1 | * | 5/2004 | H05K 3/421 |

* cited by examiner

COIL COMPONENT AND METHOD FOR MANUFACTURING THE SAME

CROSS-REFERENCE TO RELATED APPLICATION(S)

This application claims the benefit of priority to Korean Patent Application No. 10-2017-0127952, filed on Sep. 29, 2017 in the Korean Intellectual Property Office, the disclosure of which is incorporated herein by reference in its entirety.

BACKGROUND

1. Field

The present disclosure relates to a coil component and a method for manufacturing the same, and specifically, to a coil component utilized as a high frequency inductor and a method for manufacturing the same.

2. Description of Related Art

In recent years, due to the miniaturization and thinning of electronic products, demand for miniaturization, high conformity/high density, high reliability, cost reductions, and the like, of an inductor, have increased. In the related art, a multilayer high frequency inductor is an inorganic material chip component manufactured by repeatedly stacking a metal pattern and a ferrite sheet and then sintering. In this case, a method in which pattern shape and conformity force are excellent is required to be adopted. For example, a method in which pattern layers for forming a circuit are stacked using a dispersion compensating fiber (DCF), based on a printed circuit board process according to the related art, subsequently disposing a photosensitive insulating material for forming a via, and processing a via hole by expressing and developing methods, is included. In that case, as a photosensitive insulating material for the via, a material having high rigidity, capable of forming a fine via, is required. In particular, in order to secure rigidity, an insulating material including a filler is used. When the insulating material is used to form the fine via, there is a risk that a filler residue and a resin residue may remain at a lower portion of the via, due to an influence of Cz roughness.

SUMMARY

An aspect of the present disclosure may provide a coil component capable of securing reliability by removing the possibility of defects, in which, when forming a via, residues of materials such as a filler, a resin, and the like, remain on a lower portion of the via, and height deviations, and the like, of a bump electrode formed on an upper portion of the via, occur due to imbalance of a via shape.

According to an aspect of the present disclosure, a coil component includes: a body having a multilayer structure in which a plurality of pattern layers are stacked; and external electrodes disposed on an external surface of the body; wherein each of the plurality of pattern layers includes a conductive pattern, a via electrode connected to the conductive pattern, and an insulating material surrounding the conductive pattern and the via electrode, the via electrode includes an upper region in a position higher than that of the conductive pattern in the same pattern layer and a lower region in contact with the conductive pattern, and a lower surface of the lower region includes a curved portion.

According to another aspect of the present disclosure, a method for manufacturing a coil component includes: forming a plurality of pattern layers, and stacking and pressing the plurality of pattern layers, wherein the forming of the plurality of pattern layers includes preparing a substrate, forming a conductive pattern on the substrate, laminating an insulating material to seal the conductive pattern, laminating an insulating film on the insulating material, forming a through hole in the insulating film by exposing and developing a portion of the insulating film, processing a via hole so that the insulating material in a position corresponding to the through hole penetrates and a portion of the conductive pattern is etched, peeling the insulating film, forming a via electrode by filling an inner portion of the via hole with a conductive material, laminating a mask on the insulating material, removing the substrate, and removing the mask.

According to another aspect of the present disclosure, a method for manufacturing a coil component includes steps of: forming a plurality of pattern layers; and preparing a laminate by stacking and pressing the plurality of pattern layers. The step of forming the plurality of pattern layers includes: forming a conductive pattern on an upper surface of a substrate; laminating an insulating material on the substrate to enclose the conductive pattern; laminating an insulating film on the insulating material; forming a through hole in the insulating film to expose the insulating material; forming a via hole that penetrates the insulating material and a portion of the conductive pattern; and forming a via electrode in the via hole. A lower surface of the via electrode includes a curved portion.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Embodiments of the present disclosure will now be described in detail with reference to the accompanying drawings.

Hereinafter, a coil component according to an exemplary embodiment of the present disclosure and a method for manufacturing the same will be described, but the present disclosure is not necessarily limited thereto.

Coil Component

Figure 1:
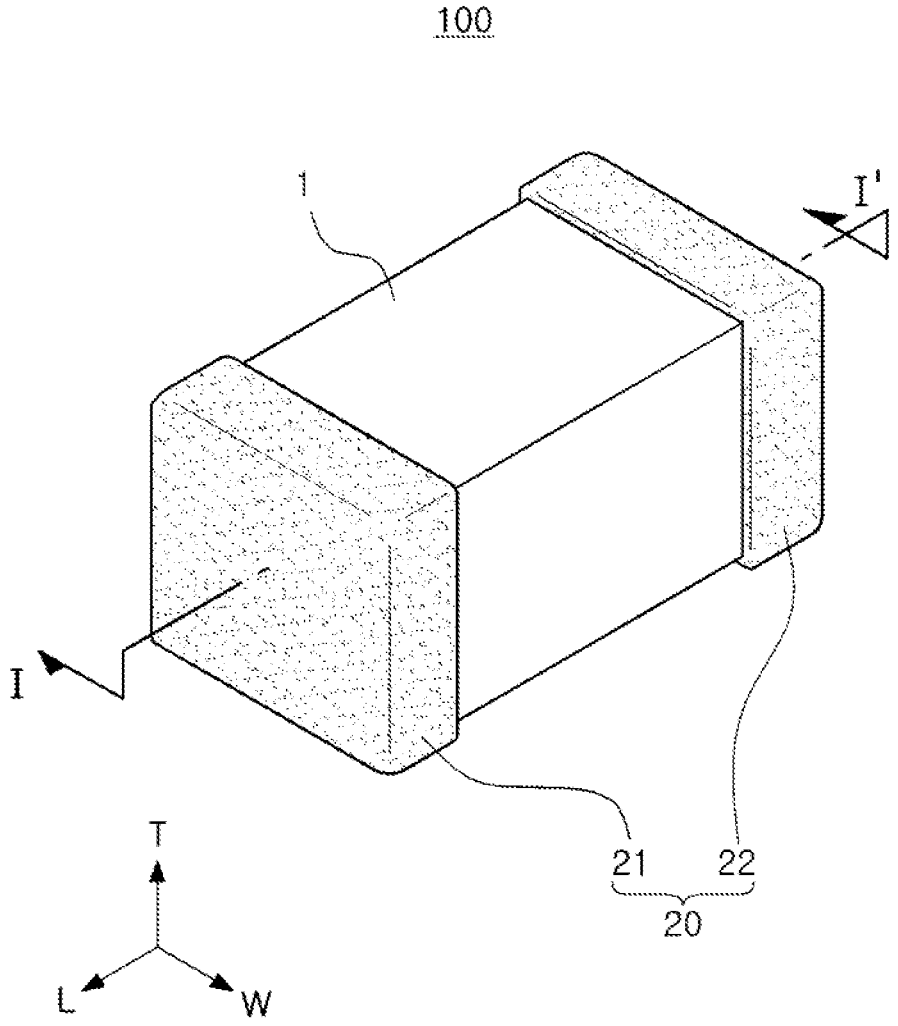
FIG. 1 is a schematic perspective view of a coil component according to an exemplary embodiment of the present disclosure.
Figure 2:
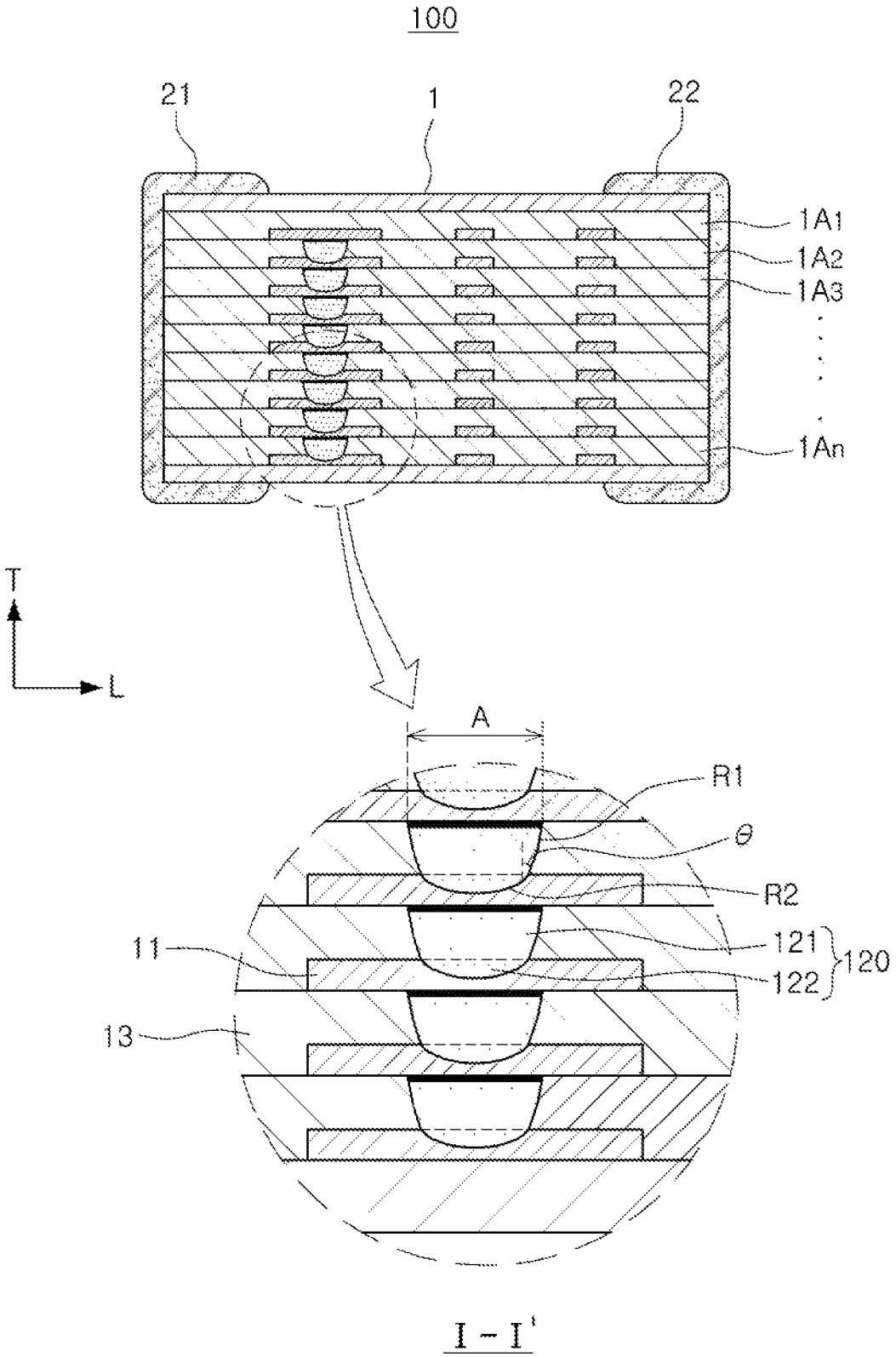
FIG. 2 is a schematic cross-sectional view taken along line I-I' of FIG. 1.

FIG. 1 is a schematic perspective view of a coil component according to an exemplary embodiment of the present disclosure, and FIG. 2 is a schematic cross-sectional view taken along line I-I' of FIG. 1.

Referring to FIGS. 1 and 2, the coil component 100 includes a body 1 and external electrodes 20.

The external electrodes 20 include a first external electrode 21 and a second external electrode 22 facing each other. The first and second external electrodes may be configured to face each other and have a C shape, but are not limited thereto. The first and second external electrodes may be simultaneously disposed on the same external surface of the body as lower surface electrodes, and may have an L shape.

An outer shape of the body 1 may have a generally hexahedral shape, and may include an upper surface and a lower surface opposing each other in a thickness direction, a first end surface and a second end surface opposing each other in a length direction, and a first side surface and a second side surface opposing each other in a width direction, but is not limited thereto.

The body 1 may have a multilayer structure in which a plurality of pattern layers $\mathbf{1}A_1$, $\mathbf{1}A_2$, $\mathbf{1}A_3$, and the like, are stacked. Each of the pattern layers may include a conductive pattern 11 and a via electrode 120 on the conductive pattern, and may include an insulating material 13 surrounding the conductive pattern 11 and the via electrode 120.

The insulating material 13 substantially determines the outer shape of the body, and the insulating material 13 is not limited to a photosensitive insulating material, but may be a thermosetting insulating material. This is a possible example since exposing/developing processes according to the related art are not used when a portion of the insulating material is opened and a via hole is processed as will be described later. For example, the photosensitive insulating material may include a polyamide resin, a photosensitive polyester resin, and the like. The thermosetting insulating material may be an epoxy resin, an amino resin, and the like, but may be appropriately selected by those skilled in the art, and may not be limited to only specific insulating materials. Meanwhile, when the insulating material is the photosensitive insulating material, an entire area of the photosensitive insulating material may be subjected to UV front exposure treatment, whereas when the insulating material is the thermosetting insulating material, an entire region of the thermosetting insulating material may be cured.

When reviewing the conductive pattern and the via electrode sealed with the insulating material, a portion of the conductive pattern may be be in physical contact with the via electrode, and a portion physically contacting the via electrode may be referred to as a via pad. The via electrode 120 may function to electrically connect the respective pattern layers. The via electrode 120 may be divided into an upper region 121 and a lower region 122. Aside surface of the upper region may be inclined and a lower surface of the lower region may have a curved portion. The division between the upper and lower regions is for convenience of explanation, and the upper and lower regions may be substantially integrated without boundary therebetween. The lower region of the via electrode means a region filled with a conductive material of the via electrode after a portion of the conductive pattern is etched, and the upper region of the via electrode refers to the via electrode remaining except for the lower region of the via electrode.

Further, the lower surface of the lower region 122 of the via electrode 12 may include the curved portion, and the curved portion may substantially complement an interface from which a portion of an upper surface of the via pad has been removed. In this case, a radius of curvature R2 of the curved portion is not particularly limited, but may be half or more to 5 times or less a length A of an upper surface of the corresponding via electrode. When the radius of curvature of the curved portion of the lower surface of the lower region is more than 5 times the length A of the upper surface of the corresponding via electrode, a substantially planar shape may be provided, such that an effect of removing residues may not be sufficiently exhibited. When the radius of curvature of the curved portion of the lower surface of the lower region is less than half the length A of the upper surface of the corresponding via electrode, it may be difficult to implement process control in a real product. The radius of curvature means a substantial radius of curvature. It is difficult to maintain the same radius of curvature throughout the curved portion since a predetermined level of surface roughness inevitably occurs when the via hole is processed. Accordingly, a value obtained by averaging a plurality of curvature radii at each point of the curved portion may be defined as a substantial radius of curvature of the curved portion. Since the lower surface of the lower portion of the via electrode 120 has the curved portion, a surface area that may be plated when the conductive material in the via electrode is filled may be increased, as compared to when the lower surface of a general via electrode is flat. Therefore, it may facilitate controlling a height of the via electrode. In addition, unlike a case in which an undercut structure frequently occurs around the lower surface of the general via electrode, the lower region 122 of the via electrode does not have the undercut structure, such that circulation of a plating liquid may be facilitated, and the shape of the via electrode may be well controlled. In addition, a resin residue or a filler residue is not substantially present in the lower region of the via electrode 12, such that resistance may be reduced to improve Q characteristic.

The side surface of the upper region 121 of the via electrode 120 may have an inclined surface, and the upper region may have a generally tapered shape, that is, a shape that becomes narrower toward the bottom. The degree of inclination)(° of the inclined surface shown in FIG. 2 may be 5° or more to 90° or less. When the degree of inclination is less than 5°, process control of a sandblast method may be extremely difficult due to characteristics thereof, and when the degree of inclination is more than 90°, the angle may not be feasible to implement in a manufacturing process.

Further, the side surface of the upper region 121 of the via electrode 12 may have a shape of the inclined surface and simultaneously may include a predetermined radius of curvature R1. For example, the radius of curvature may be one third or more to half or less a length A of the upper surface of the corresponding via electrode. When the radius of curvature of the side surface of the upper region is out of the numerical range, it may be difficult to control the shape through the sandblast method. Besides the range of the radius of curvature, the radius of curvature may be appropriately selected within a processable range in consideration of a desired characteristic or a process environment as understood by those skilled in the art.

A material of the via electrode is not particularly limited as long as it is a conductive material, and may be, for example, Cu. In addition, a Cu/Sn composite layer further including Sn on the Cu layer may be formed. Moreover, an Sn layer may also be formed on the Cu layer. In this case, the lower region of the via electrode may be formed of Cu as a main component, while the upper region of the via electrode may be formed of Sn as a main component on a portion formed of Cu as the main component.

The via electrode and the above-described conductive pattern may together from a general coil shape, and the coil shape may have a generally spiral shape.

One end of the coil shape may be exposed to the external surface of the body and physically contact the first external electrode, and the other end may be exposed to the external surface of the body and physically contact the second external electrode.

Method for Manufacturing Coil Component

FIG. 3A through 3J are schematic views illustrating a method for manufacturing a coil component according to another exemplary embodiment of the present disclosure.

Figure 3A:
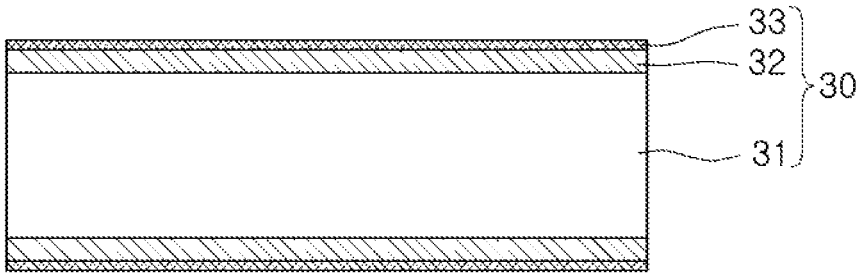
FIG. 3A through 3J are views illustrating a process according to a method for manufacturing a coil component according to another exemplary embodiment of the present disclosure.

FIG. 3A illustrates a step of preparing a substrate 30, wherein a plurality of metal layers may be sequentially stacked on an upper surface and a lower surface of a support member 31. For example, the plurality of metal layers may be formed by stacking a carrier copper 32 and a seed copper 33. In this case, the support member 31 is not particularly limited as long as it is a material having sufficient rigidity to support coil layers formed on the upper surface and the lower surface. For example, the support member may be a PPG substrate. In addition, as an example, dispersion compensating fiber (DCF) may be utilized as a substrate, wherein the DCF is appropriately used as the substrate since the DCF has a structure in which an epoxy resin filled with a glass fiber and inorganic filler is used as a base layer, and copper films are formed as metal layers on both surfaces thereof.

Figure 3B:
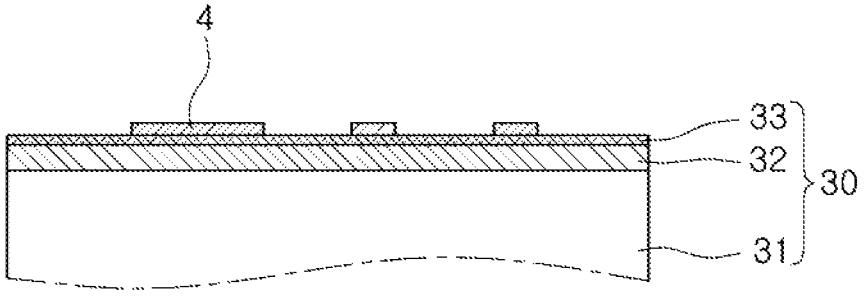

FIG. 3B illustrates a step of forming a conductive pattern 4 having a predetermined pattern on the upper surface of the substrate prepared in FIG. 3A. In this case, the predetermined pattern may be appropriately explained as necessary by those skilled in the art, and may be a generally spiral shape. Meanwhile, when the formation of the conductive layer pattern is applied in the same manner even to the lower surface of the substrate, mechanical strength may be maintained symmetrically and stably. However, for convenience of explanation, only a configuration of the upper surface of the substrate is shown from FIG. 3B. A description of the configuration of the upper surface of the substrate may be applied as it is even to the lower surface of the substrate.

Figure 3C:
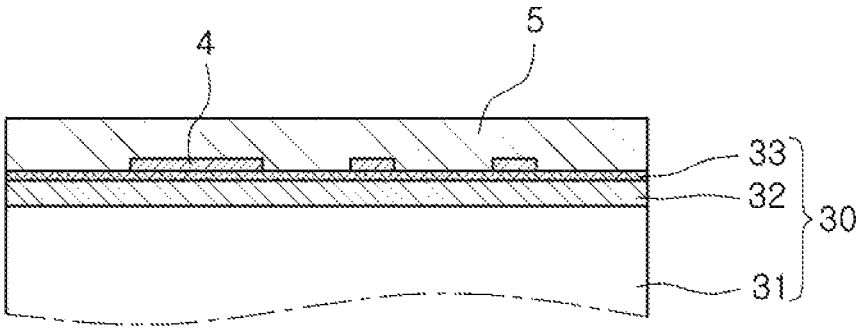

FIG. 3C illustrates a step of laminating an insulating material 5 for connecting the upper layer and the lower layer. The insulating material is not limited to being a photosensitive insulating material capable of being exposed and developed, and may be a high-rigidity thermosetting insulating material. This is because, unlike conventional exposure and development or utilization of a laser, a sandblasting method is used in order to forma via in an insulating material as in a process as will be described later, such that a degree of freedom in selecting a material for an insulating material is secured.

Figure 3D:
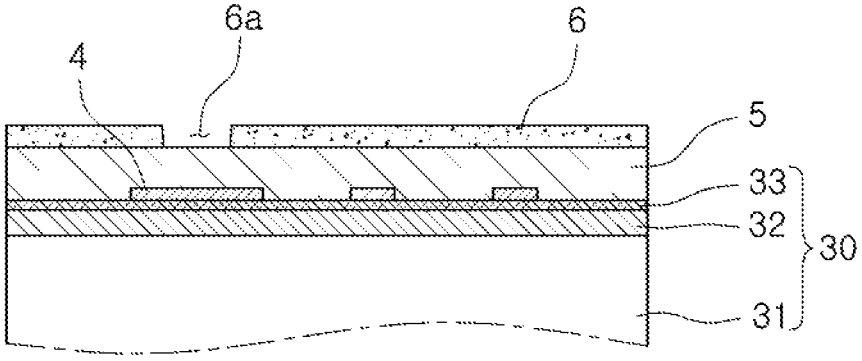

Next, FIG. 3D is a step of laminating an insulating film 6 on the insulating material, and subsequently exposing and developing the insulating film to open the insulating film so that a through hole 6*a* is formed in the insulating film only in a position corresponding to a position at which the via is formed. The insulating film may be any material as long as it is a thin film insulating material, but may be a dry film resist (DFR). Meanwhile, although not shown in detail, when the insulating material is the photosensitive insulating material, all of the applied insulating material may be cured by UV front exposure before laminating the DFR on the insulating material. When the insulating material is the thermosetting insulating material, the insulating material may be thermally dried and cured.

Figure 3E:
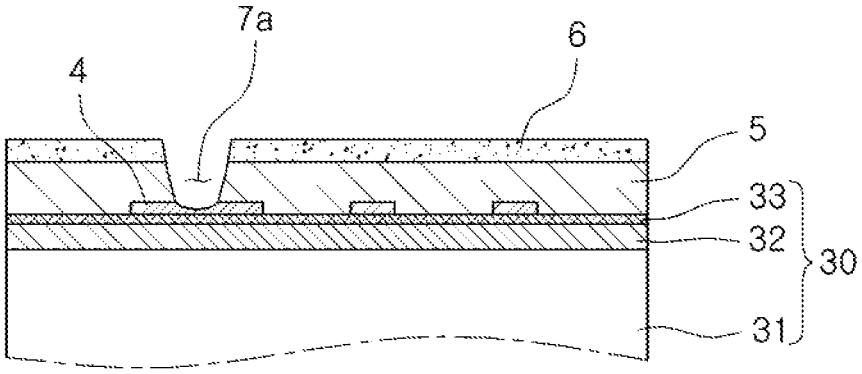

FIG. 3E illustrates a step of applying a sandblasting method for processing a via hole 7*a*. The sandblast method is a method of polishing or cutting an object surface by spraying a polishing agent onto a target surface from a nozzle. The polishing agent may be a ceramic powder such as an alumina (aluminum oxide), silicon carbide, or the like, a plastic powder, or the like. The via hole formed using the sandblasting method not only opens only a portion of the insulating material but also removes a portion of a copper pad sealed in the insulating material, wherein a polishing speed of a conductive material of the copper pad is slower than that of the insulating material, and as a result, the filler residue or the resin residue that may remain may be removed by removing the insulating material. In addition, the via hole formed by applying the sandblast may have a roughly elliptical earthenware shape, and a surface of the copper pad formed in FIG. 3B after the polishing may be partially exposed. As described above, an exposed area of the copper pad after the polishing may have a larger surface area than a substantially planar bottom of a via hole according to the related art. Therefore, when the via electrode is formed by filling an inner portion of the via hole, a plating thickness of the via electrode may be easily controlled. Since the plating area of the via electrode is significantly small, it may be difficult to finely control a height of the via electrode. However, when the via hole is processed by using the sandblast, the surface area of the bottom of the via hole may be widened, which may be advantageous for controlling the height of the via electrode. In addition, when the via hole is processed by using the sandblast, an undercut structure may not be formed, such that a height deviation of the via electrode may be reduced, which may be advantageous for circulating the plating liquid of the via electrode.

Figure 3F:
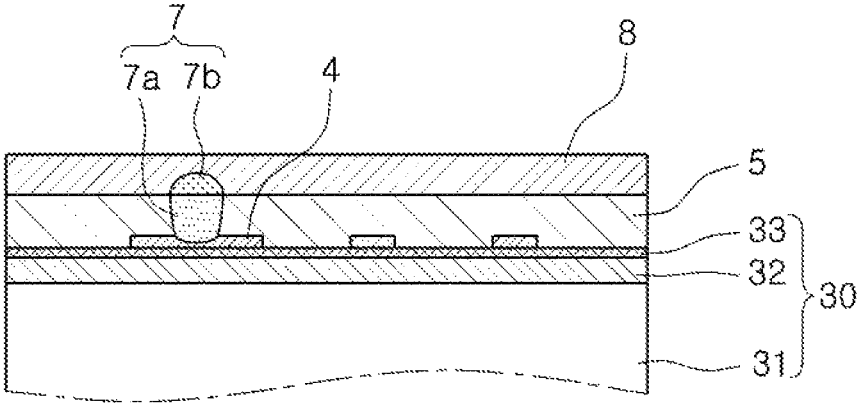

FIG. 3F is a step of peeling the insulating film 6 (which may be DFR) and then filling the inner portion of the via hole with a metal material, for example, Cu, to form the via electrode 7. In this case, the via hole may be filled with a Cu layer 7*a* and a Sn layer 7*b* may be disposed above the Cu layer in order to form the via electrode as a bump electrode.

Figure 3G:
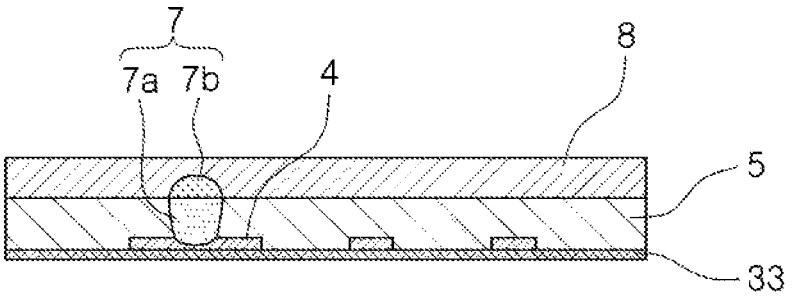

FIG. 3G is a step of laminating a mask 8 and then detaching the substrate. An interface between the carrier copper and the seed copper may be detached to in the step of removing the substrate. Here, the mask may be an F-mask, but is not limited thereto.

Figure 3H:
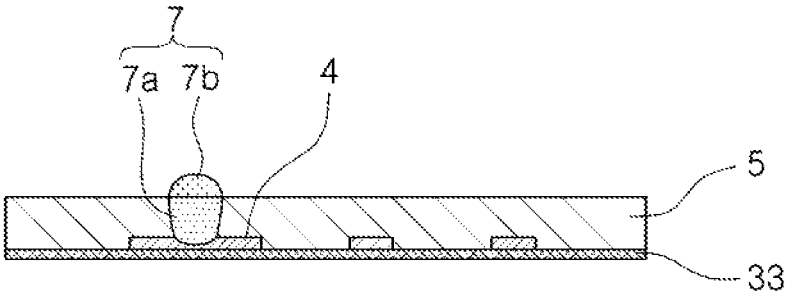

In FIG. 3H, the remaining seed copper 33 may be removed by etching, and the F-mask may also be removed, and then a pattern layer 9 including each conductive pattern layer may be formed.

Figure 3I:
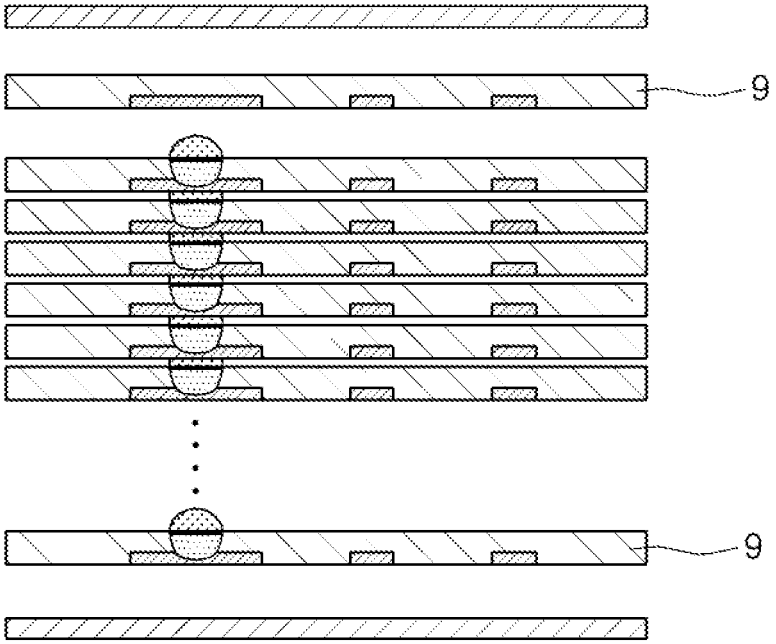

Next, FIG. 3I illustrates a step of repeatedly forming the pattern layer 9, and then conformally stacking the plurality of pattern layers.

Figure 3J:
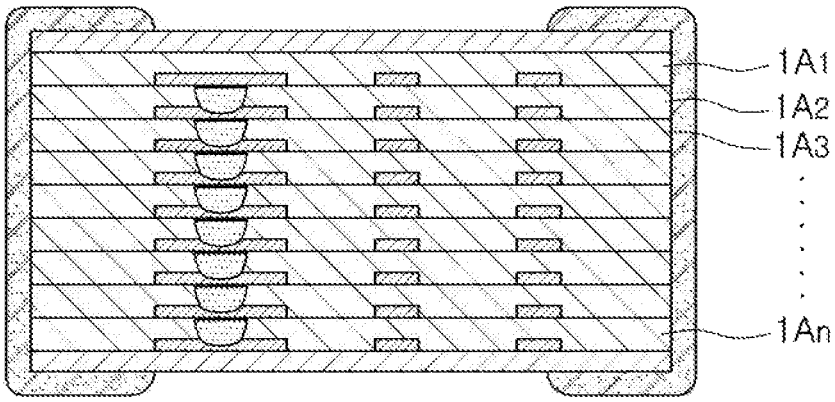

FIG. 3J illustrates the plurality of the conductive patterned layers obtained by pressing the conformally stacked conductive pattern layers and performing a post-process for forming the coil component such as dicing, polishing, external electrode plating, or the like.

According to the coil component and the method for manufacturing the same as described above, an incidence of residue being disposed on the via bottom may be reduced to improve reliability as compared to a related art method for forming a via. Further, since the surface area is larger than the bottom area of the via hole according to the related art when a portion of the surface of the Cu pad is exposed after polishing, the plating thickness of the via electrode may be easily controlled. In addition, since the undercut structure may not be formed when the via hole is processed, the height deviation of the via electrode may be decreased, and the circulation of the plating liquid in the via hole may be smooth.

A description of features overlapping those of the coil component according to an exemplary embodiment in the present disclosure described above except for the above-described description will be omitted.

As set forth above, according to the exemplary embodiment in the present disclosure, a coil component where incidence of unnecessary resin residue and filler residue on the lower surface of the via may be prevented and shape reliability of the via and the bump electrode on the upper portion of the via, and the like, may be secured, may be provided.

While the present disclosure has been shown and described in connection with the embodiments, it will be apparent to those skilled in the art that modifications and variations can be made without departing from the spirit and scope of the disclosure as defined by the appended claims.

What is claimed is:

1. A coil component comprising:

a body having a multilayer structure in which a plurality of pattern layers are stacked in a stacking direction; and external electrodes disposed on an external surface of the body;

wherein each of the plurality of pattern layers includes a conductive pattern, a via electrode connected to the conductive pattern, and an insulating material surrounding the conductive pattern and the via electrode, the via electrode includes an upper region in a position higher than that of the conductive pattern in a same pattern layer and a lower region in contact with the conductive pattern, a lower surface of the lower region includes a curved portion having a maximum width less than a width of a lower portion of the upper region, and a lowermost portion of the curved portion is arranged between the conductive pattern and the upper region in the stacking direction.

2. The coil component of claim 1, wherein the insulating material is a photosensitive insulating material.

3. The coil component of claim 1, wherein the insulating material is a thermosetting insulating material.

4. The coil component of claim 1, wherein a radius of curvature of the curved portion is half or more to 5 times or less a length of an upper surface of the via electrode.

5. The coil component of claim 1, wherein a side surface of the upper region is a tapered inclined surface.

6. The coil component of claim 5, wherein an angle of the inclined surface is 5 degrees or more to 90 degrees or less.

7. The coil component of claim 5, wherein a radius of curvature of the side surface of the upper region is one third or more to half or less a length of an upper surface of the via electrode.

8. The coil component of claim 1, wherein a boundary surface of the conductive pattern in direct contact with the via electrode is disposed in a position lower than an uppermost surface of the conductive pattern in the same pattern layer.

9. The coil component of claim 1, wherein the upper and lower regions of the via electrode are integrally formed without a boundary surface.

10. The coil component of claim 1, wherein the upper region includes at least one interface, and a conductive material having a different composition is included based on the interface.

11. The coil component of claim 10, wherein the upper region includes a Cu layer and a Sn layer on the Cu layer.

12. The coil component of claim 1, wherein the lower surface of the lower region has a shape to complement a boundary surface of the conductive pattern in direct contact with the via electrode.

* * * * *